US005109473A

United States Patent [19]

Rezabek et al.

[11] Patent Number: 5,109,473

[45] Date of Patent: Apr. 28, 1992

[54] HEATER ASSEMBLY FOR USE IN A CORROSIVE ENVIRONMENT

[75] Inventors: Dennis J. Rezabek, Kirtland; Richard A. Lokar, Orwell, both of Ohio

[73] Assignee: Process Technology Inc., Mentor, Ohio

[21] Appl. No.: 629,267

[22] Filed: Dec. 18, 1990

[51] Int. Cl.[5] ..... H05B 1/02; H05B 3/80

[52] U.S. Cl. ..... 392/497; 219/523; 219/541; 219/544; 338/243; 338/273; 338/326; 392/448; 392/498; 392/503

[58] Field of Search ..... 219/523, 541, 544, 534; 338/273, 274, 276, 232-237, 243-250, 326; 392/497, 498, 503, 448

[56] References Cited

U.S. PATENT DOCUMENTS

| | | | |
|---|---|---|---|
| 1,365,978 | 1/1921 | Gallager . | |
| 2,614,200 | 10/1952 | McNair . | |
| 2,654,820 | 10/1953 | Irving . | |
| 2,784,292 | 3/1957 | Haloski . | |
| 3,403,368 | 9/1968 | Scardina . | |
| 3,632,977 | 1/1972 | Takayasu | 219/523 X |
| 3,719,799 | 3/1973 | Takayasu | 219/523 |
| 4,068,116 | 1/1978 | McKimstry | 219/523 |
| 4,234,785 | 11/1980 | Lefebvre | 219/523 |
| 4,551,619 | 11/1985 | Lefebvre | 219/523 |

FOREIGN PATENT DOCUMENTS

| | | | |
|---|---|---|---|
| 2266419 | 10/1975 | France | 219/523 |

*Primary Examiner*—Anthony Bartis

[57] ABSTRACT

A heater assembly for heating a container of corrosive fluid includes a housing adapted to be located in a container of fluid to be heated, a sealed chamber located in the housing, a heater located in the chamber, an electrically conductive sleeve assembly secured to the housing, and a flexible conduit extending from the sleeve assembly and providing a passageway for conductors providing a source of power to the heater assembly. The flexible conduit includes an electrical conductor connected to ground which is located in the sleeve assembly and the sleeve assembly is swaged to compress the sleeve assembly into the electrical conductor to ground to the electrically conductive housing via the sleeve assembly.

7 Claims, 2 Drawing Sheets

HEATER ASSEMBLY FOR USE IN A CORROSIVE ENVIRONMENT

DESCRIPTION

1. Technical Field

The present invention relates to an electrical resistance heater assembly for use in a corrosive environment and more particularly, to a heater assembly which is adapted to be located in a container of corrosive fluid, such as electroplating chemicals, and which is connected to a suitable control and power source via a flexible, grounded, corrosion resistant conduit which is grounded to the housing of the heater assembly.

2. Background of the Invention

Heater assemblies for use in corrosive environments are well known. The known heater assemblies include sealed corrosion resistant housings which are connected to a source of control and/or power via a rigid conduit or riser. Such constructions suffer from the disadvantage that the rigid conduit or riser may have to be specifically contoured to the specific container in which it is desired to locate the heater assembly. For example, many containers for electroplating baths and the equivalent include electrified bus bars and racks which hold parts to be immersed into the electroplating bath without contacting the conduit assembly. Such a construction necessitates custom manufactured heater assemblies which must be configured to clear all bus bars, racks and other tank appurtenances.

SUMMARY OF THE INVENTION

The present invention provides a new and improved heater assembly which is particularly adapted for use in corrosive environments of various configurations and which include a flexible conduit which is grounded to the heater assembly.

A provision of the present invention is to provide a new and improved heater assembly for heating a container of corrosive fluid which includes a metallic electrically conductive corrosion resistant housing adapted to be located in a container of corrosive fluid to be heated and which defines a sealed chamber therein in which an electrical resistance heater is located. A metallic electrically conductive sleeve assembly is secured to the housing and a flexible conduit extends from a source of electrical power to the metallic sleeve assembly. Compression means is provided for compressing the metallic electrically conductive sleeve assembly into the flexible conduit to engage the metallic electrically conductive sleeve assembly with an electrical conductor which is disposed in the flexible conduit to ground the electrical conductor disposed in the flexible conduit through the metallic sleeve assembly and the metallic housing.

Another provision of the present invention is to provide a heater assembly for heating a container of corrosive fluid, including a metallic electrically conductive corrosion resistant housing adapted to be located in the container of corrosive fluid and defining a sealed chamber therein in which an electrical resistance heater is located. A metallic electrically conductive sleeve assembly is secured to the housing and defines a first passageway therein which communicates with the sealed chamber. A flexible corrosion resistant conduit having an electrical conductor disposed thereon extends from a source of power to the metallic sleeve assembly and includes at least a pair of conductors extending through a second passageway defined in the flexible conduit. The first passageway in the metallic sleeve is connected to the second passageway in the flexible conduit which is connected to the sealed chamber in the electrically conductive housing. A compression means is provided for compressing the metallic electrically conductive sleeve assembly into the flexible conduit to engage the metallic sleeve assembly with the electrical conductor disposed on the flexible conduit to ground the electrical conductor disposed in the flexible conduit through the metallic sleeve assembly to the metallic housing.

Still another provision of the present invention is to provide a new and improved heater assembly as defined in the preceding paragraph wherein the metallic sleeve assembly includes a cylindrical metallic outer sleeve secured to the metallic housing and a substantially cylindrical metallic inner sleeve which defines in part the first passageway therein secured to the metallic outer sleeve. The metallic cylindrical inner sleeve is disposed substantially coaxial to the outer sleeve and forms an annular chamber having an inner and outer cylindrical walls defined by the inner and outer sleeves. The flexible conduit includes an end thereof located and secured in the annular chamber defined between the inner and outer sleeves.

DESCRIPTION OF THE PREFERRED EMBODIMENT

Figures 1, 2, 3:
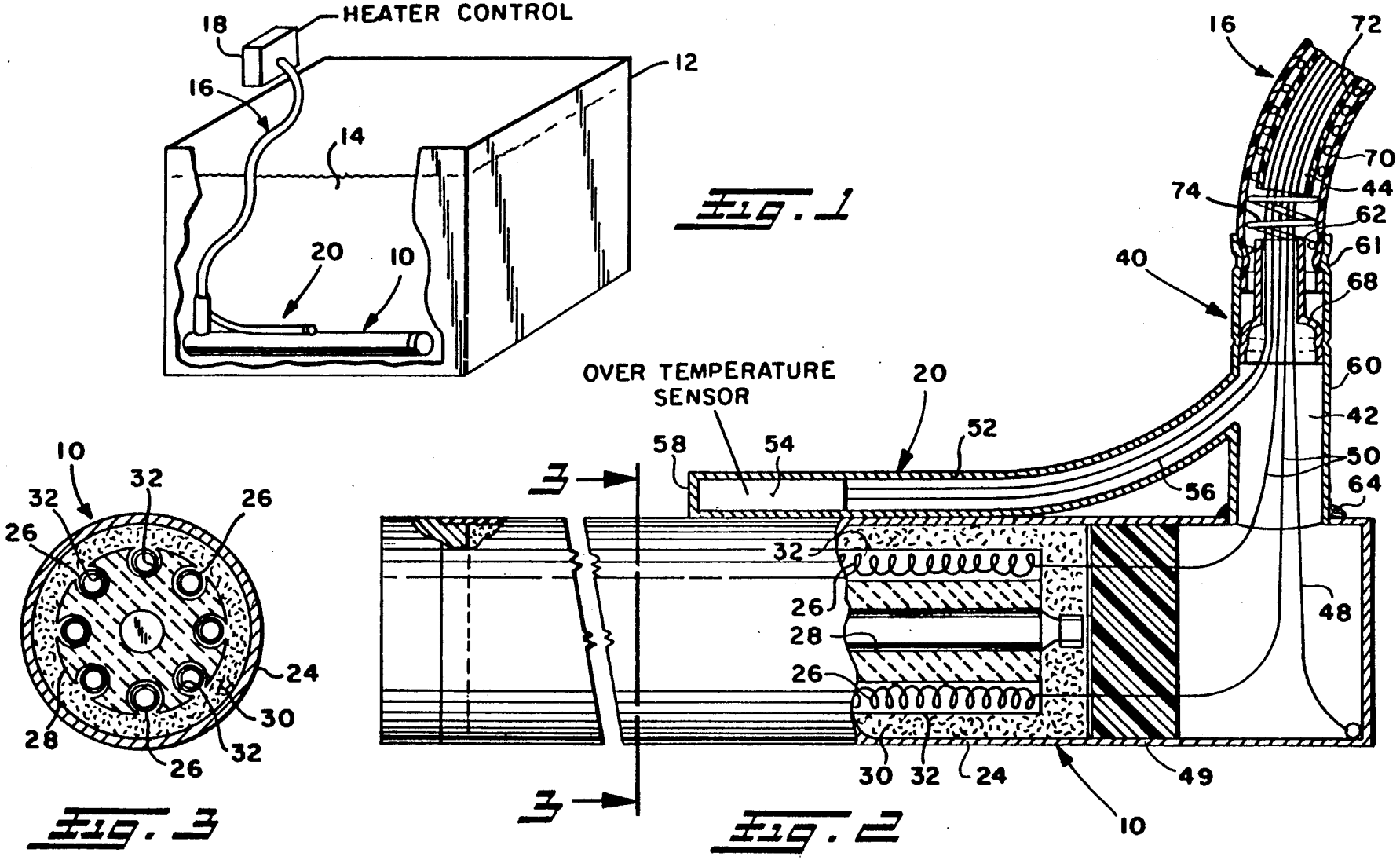
FIG. 1 is a schematic view showing the heater assembly of the present invention located in a container of corrosive fluid.
FIG. 2 is a cross-sectional view more fully illustrating the heater assembly of the present invention.
FIG. 3 is an end-sectional view taken approximately along the lines 3—3 of FIG. 2.

Referring to the figures, and more particularly, FIGS. 1 and 2, a heater assembly 10 is illustrated disposed in a container 12 of fluid 14 to be heated. The fluid may be corrosive fluid such as an electroplating bath and it is important for the heater assembly 10 to be completely sealed to prevent the leakage of the corrosive fluid into the heater assembly 10. A flexible conduit 16 extends from the heater assembly 10 and is connected to a control 18 located outside of the tank 12. The control 18, as is well known, is connected to a suitable source of energy for energizing the heater assembly 10 and is also connected to a ground to ground the heater assembly 10, as will be described more fully hereinbelow. In addition, the control 19 is connected to an overtemperature sensor assembly 20 which is adapted to cooperate with the control 18 to limit the temperature of the heater assembly 10, in the event of loss of fluid (which acts as a heatsink) or if the fluid level drops and the heater assembly 10 is no longer immersed in the fluid 14.

In the preferred embodiment, as is illustrated in FIG. 1, the heater assembly 10 is located at the bottom of the container 12 of fluid to effect heating of the fluid 14. The heater could be located in other locations in the container 12 to effect heating of the fluid 14 by the bottom is the preferred location. While the container 12 has been disclosed as a substantially rectangular container, it should be appreciated that the container can have many shapes and sizes and can be adapted to have racks which support parts to be dipped into the fluid 14. The construction of the container 12 is to provide easy ingress and egress for the parts, secure electric bus bars, pumps, filters and other internal accessories required for control of the electroplating process, not illustrated, to be dipped in the fluid 14 and the location of the heater assembly 10 and flexible conduit 16 is disposed so as not to interfere with the placement and removal of the parts and accessories in the container 12 of electroplating fluid 14.

Referring more particularly to FIGS. 2 and 3 cross-sectional views of the heater assembly 10 are illustrated. The heater assembly 10 includes a metallic electrically conductive corrosion resistant housing 24 which in the preferred embodiment has a cylindrical configuration. The housing in the preferred embodiment is constructed from corrosion resistant metal which in the preferred embodiment may be stainless steel and defines a chamber 30 disposed within the housing 4. A plurality of electric resistance heaters 26 are located within the chamber 30 disposed within the housing 24. A fluted cylindrical ceramic core 28 is located within the chamber 30 of the housing 24 and is adapted to support the electrical resistance heaters 26. As is more fully illustrated in FIG. 3, the fluted cylindrical ceramic core includes a plurality of cylindrical flutes 32 which extend along the axial length of the ceramic core 28. Each of the cylindrical flutes 32 is adapted to support an electrical resistance heater 26 therein. In the preferred form of the invention, the electrical resistance heaters 26 are formed from coiled resistance wire supported in the flutes 32 in a well-known manner.

After the fluted ceramic core 28 and the resistance heaters 26 are located within the chamber 30 disposed in the housing 24, magnesium oxide is compacted into the chamber 30 in a well-known manner to fill the voids between the housing 24 and the ceramic core 28. The magnesium oxide acts to support the fluted ceramic core 28 within the sealed chamber 30. The magnesium oxide is an electrically insulative material which insulates the resistance heaters 26 from the housing 24 and is also an excellent heat conductor to conduct heat away from the resistance heaters 26 to heat the fluid 14 disposed about the housing 24 in the container 12.

A metallic electrically conductive sleeve assembly 40 is disposed on one end of the housing 24. The metallic electrically conductive sleeve assembly 40, more fully illustrated in FIGS. 4 and 5, includes a first passageway 42 disposed therein which communicates with one end of the sealed chamber 30 in the housing 24. A flexible conduit 16 is adapted to be located and secured in the metallic sleeve assembly 40. The flexible conduit 16 includes a second passageway 44 located therein which communicates with the first passageway 42 in the metallic sleeve assembly 40. A plurality of conductors 48, 50 and 56 pass from the control 18 through the passageway 44 located in the flexible conduit 16, through the passageway 42 located in the metallic sleeve assembly 40 and into one end of the sealed chamber 30 in the heater housing 24. The plurality of electrical conductors include a ground conductor 48 which is secured to one end of the metallic electrically conductive corrosion resistant housing 24, see FIG. 2, and a plurality of conductors 50 which provide power to the electrical resistance heaters 26. A suitable hermetic seal 49 is disposed at one end of the housing 24 to seal the portion of chamber 30 in which the resistance heaters 26 can be located and to support and seal the conductors 50 as they pass into the sealed portion of chamber 30.

The sensor assembly 20 includes an overtemperature sensor 54 which is disposed within a sealed housing 52 disposed adjacent to the heater housing 24 for sensing the temperature of the heater assembly 10 located within the container 12. The sensor housing 52 defines a sealed sensor chamber 58 which is connected to the first passageway 42 disposed in the metallic sleeve assembly 40. A pair of conductors 56 extend from the overtemperature sensor 54 through the sealed chamber 52 to the passageway 42 in the metallic sleeve assembly 40 and through the passageway 44 in the flexible conduit 16 to the control 18. The overtemperature sensor 20 cooperates in a well-known manner with the control 18 to denergize 26 when a predetermined temperature is sensed by the overtemperature sensor 54.

The metallic sleeve assembly 40 includes a cylindrical outer sleeve 60 which is connected to the housing 24 by suitable means such as welding at 64 to provide a fluid tight seal to prevent leakage of fluid 14 into the chamber 30 in the housing 24. A sleeve assembly 40 further includes a substantially cylindrical metallic inner sleeve 62, which cooperates with outer sleeve 60 to in part define the passageway 42 through the metallic sleeve assembly 40. The cylindrical inner sleeve 62 is disposes substantially coaxial to the outer sleeve 60 and forms an annular chamber 66 defined between the inner sleeve 62 and the outer sleeve 60. The inner sleeve 62 includes an annular flanged portion 68 which engages with the outer cylindrical sleeve 60 to support the inner sleeve 62 substantially coaxially with the outer sleeve 60. A mechanic ground path is provided between the annular flange 68 on the inner sleeve 62 and the portion of the outer sleeve 60 with which the flanged portion 68 engages to provide a ground path to sealed housing 24. The flexible conduit 16 is adapted to have one end located and secured within the annular chamber 66 disposed between the inner sleeve 62 and the outer sleeve 60.

Figure 4:
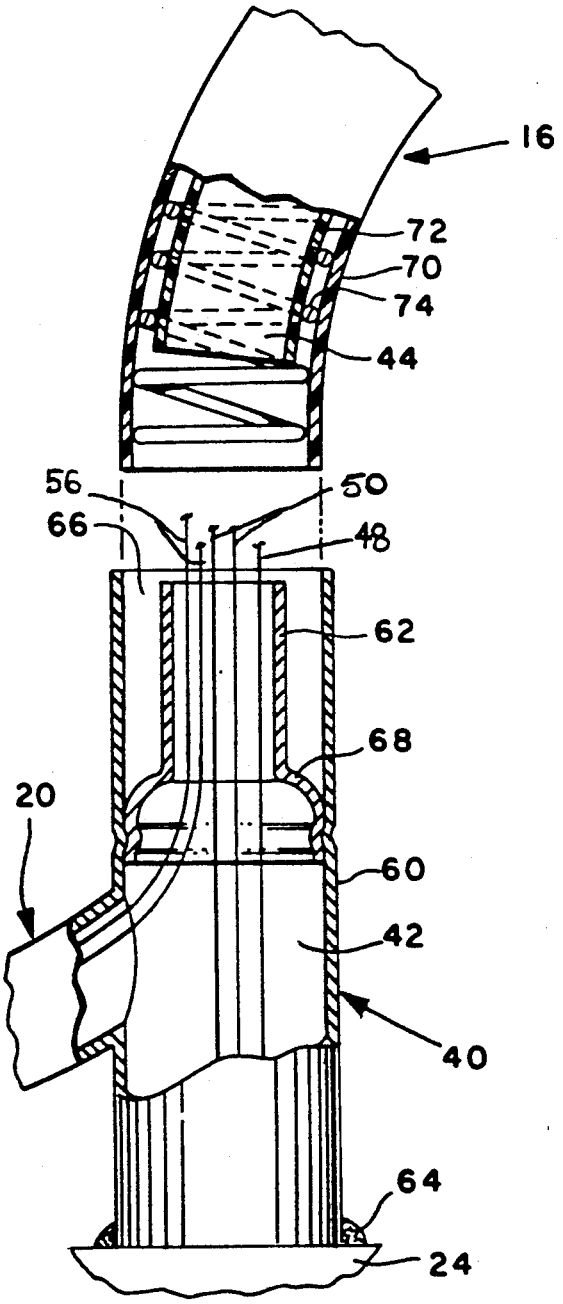
FIG. 4 is an enlarged cross-sectional view similar to FIG. 5 more fully illustrating the metallic sleeve assembly and the flexible conduit prior to the flexible conduit being secured in the metallic sleeve assembly.
Figure 5:
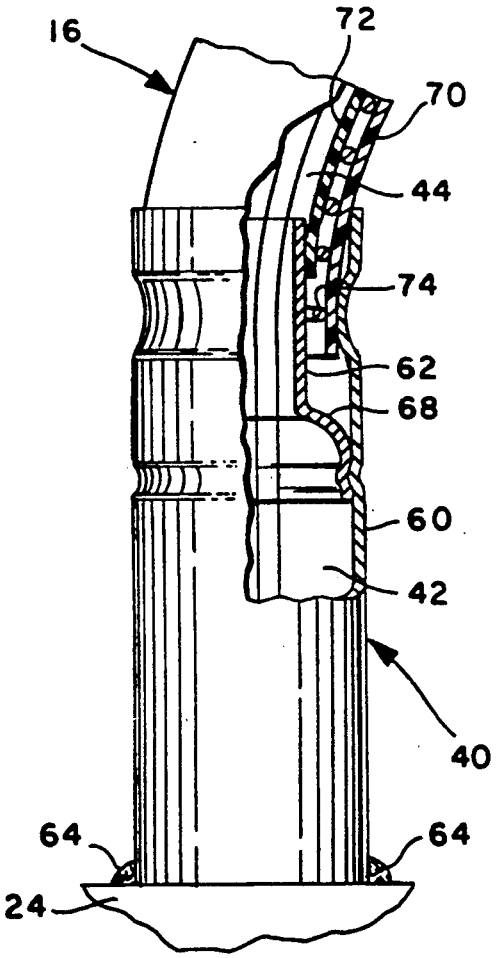
FIG. 5 is a cross-sectional view of the metallic sleeve assembly after the flexible conduit has been secured therein by compressing a portion of the outer metallic sleeve assembly.

The flexible conduit 16 more fully illustrated in FIGS. 4 and 5 includes a corrosion resistant, electrically insulative, flexible outer conduit 70, and a corrosion resistant, electrically insulated, flexible inner conduit 72 disposed substantially coaxially with the outer conduit 70. A metallic electrical conductor 74 is disposed about the inner conduit 72 between the inner conduit 72 and outer conduit 70. The electrical conductor 74 increases the strength of the flexible conduit 16 and allows electrical grounding of the flexible conduit through the grounded housing 24.

The inner tube 72 is preferably helically coiled and formed from a corrosion resistant material such as TFE, FEP, PFA, PTFE, ECTFE, ETFE or PVDF fluoropolymer. The reinforcing conductor coil 74 encircles the outer surface of the tube 72. Such tubing is manufactured by the Bunnell Plastics Division of Penntube Products. The coiled form provides much more flexibility than is possible with smooth bore tubing and the reinforcing conductor which is preferably a stainless steel conductor 74 increases the pressure capability of the flexible conduit 16 while providing a means for grounding the conduit 16 to the housing 24, as will be more fully described hereinbelow. The outer conduit 70 is preferably formed of a similar fluoropolymer material as the inner tube 72 which provides a high degree of chemical inertness together with high temperature operating capabilities.

When it is desired to attach the flexible conduit 16 to the metallic sleeve assembly 40, the internal conduit 72 is trimmed to expose the coiled stainless steel conductor 74. The end of the conduit 16 is then located in the annular chamber 66 disposed between the inner sleeve 62 and outer sleeve 60. The outer sleeve 60 is then swaged, or compressed, at 61 as is illustrated in FIG. 5 to clamp the flexible conduit 16 within the annular chamber 66 and engage the conductor 74 with the inner metallic sleeve 62. This allows the conductor 74 to be grounded via the inner sleeve 62 and outer sleeve 60, to the metallic conductive housing 24 which has the ground conductor 48 connected thereto. The ground conductor 48, along with the conductors 50, pass from the housing 24 through the first passageway 42 disposed in the metallic sleeve assembly 40 and through the second passageway 44 disposed in the flexible conduit 16 to the control 18. As has been indicated hereinabove, the control 18 include a suitable source of power and a suitable connection for the ground conductor 48.

It can be seen that by grounding the housing 24 via the ground conductor 48, the flexible conduit 16 is also grounded via the conductor 74 as the conductor 74 is connected to the housing 24 by the compression of the outer metallic sleeve 60 into the inner metallic sleeve 62. The combination of the electrically conductive grounded housing 24 with the grounded flexible conduit 16 provides a fully grounded immersion heater which provides a ground path for any stray current which may be present in the corrosive fluid in which the heater 10 is immersed. Moreover, if the heater assembly 10 should be damaged and the corrosive fluid 14 should enter the heater assembly 10, the ground path will minimize the potential injury to a user of the heater assembly.

The use of the flexible conduit 16 which is grounded by the conductor 74 provides an adaptable heater assembly 10 which can be placed in various locations in containers of corrosive fluid and in tanks having various configurations and heights. The flexible conduit 16 can be easily routed to any point at the container's surface without regard to the location of the heater assembly 10. Thus, the heater assembly 10 can accommodate various style tanks and various controls located at various positions.

From the foregoing, it should be apparent that a new and improved heater assembly 10 has been provided for heating a container 12 of corrosive fluid 14. The heater assembly 10 includes a metallic electrically conductive corrosion resistant housing 24 adapted to be located in a container 12 of corrosive fluid 14 to be heated by the heater assembly 10. The housing 24 includes a sealed chamber 30 therein and a plurality of coiled resistance wires 26 are located in the sealed chamber 30. A metallic electrically conductive sleeve assembly 40 is welded to the housing at 64 and includes a passageway 42 therein which communicates with the sealed chamber 30 in the housing 24. A corrosion resistant flexible conduit 16 extends from a source of electrical power 18 to the metallic sleeve assembly 30 and includes a metallic electrical conductor 74 disposed therein. The flexible conduit 16 defines a second passageway 44 which is connected to the first passageway 42 in the metallic sleeve assembly 40. Conductors 48, 50 and 56 extend through the passageways 42 and 44 with one of the conductors 48 being connected to the housing 24 and ground. The conductors 50 are connected to the electrical resistance heaters 26 to energize the heaters 26 and conductors 56 connect the temperature sensor to control 18. The end of flexible conductor 16 is located in the annular chamber 66 in the metallic sleeve assembly 40 and compression means secures the outer sleeve 60 in a radially inward direction toward the inner sleeve 62 to engage the inner sleeve 62 with the conductor 74 disposed in the conduit 16 to ground the electrical conductor and to secure the flexible conduit 16 in the metallic sleeve assembly.

What is claimed is:

1. A heater assembly for heating a container of corrosive fluid comprising a metallic electrically conductive corrosion resistant housing adapted to be located in a container of corrosive fluid to be heated, said housing having a sealed chamber therein, an electrical resistance heater located in said sealed chamber in said housing, a metallic electrically conductive sleeve assembly secured and electrically connected to said housing and including a first passageway therein communicating with said sealed chamber, a corrosion resistant flexible conduit adapted to be connected to a source of electrical power and connected to said metallic sleeve assembly, said flexible conduit including a metallic electrical conductor disposed therein, said conduit defining a second passageway therein in communication with said first passageway of said sleeve assembly, at least a pair of conductors extending through said second passageway of said flexible conduit, said first passageway of said metallic sleeve assembly and into said metallic electrically conductive housing, at least one of said conductors being connected to said electrical resistance heater to energize said heater and another of said conductors being a ground conductor electrically connected to said metallic electrically conductive housing and to a ground to thereby ground said metallic electrically conductive housing to minimize the possibility of stray currents passing from the heater assembly into the fluid to be heated, and compression means for compressing said metallic electrically conductive sleeve assembly into contact with said flexible conduit to force said metallic sleeve assembly into electrical engagement with said electrical conductor disposed in said flexible conduit to ground said electrically conductive conductor disposed in said flexible conduit through said metallic sleeve assembly and said metallic housing to said ground conductor.

2. A heater assembly as defined in claim 1 wherein said metallic sleeve assembly comprises a substantially cylindrical metallic outer sleeve secured to said metallic housing and a substantially cylindrical metallic inner sleeve defining in part said first passageway therein and secured to said metallic outer sleeve, said cylindrical inner sleeve being disposed substantially coaxial to said outer sleeve and forming an annular chamber having inner and outer cylindrical walls defined by said inner and outer sleeves, said flexible conduit having an end thereof located and secured by said compression means in said annular chamber defined between said inner and outer sleeves with said electrical conductor in electrical contact with at least one said outer sleeve and inner sleeve.

3. A heater assembly as defined in claim 2 wherein said means for compressing said sleeve assembly into said flexible conduit comprises an annular portion of said outer cylindrical sleeve which is swaged in a radially inward direction toward said cylindrical metallic inner sleeve to compress said portion of said outer sleeve into said flexible conduit located in said annular chamber to secure said end of said flexible conduit in said angular chamber and engage said electrical conductor located in said flexible conduit with said metallic sleeve assembly.

4. A heater assembly as defined in claim 2 wherein said inner sleeve further includes an annular flanged portion which engages with said outer cylindrical sleeve to support said inner sleeve substantially coaxial to said outer sleeve.

5. A heater assembly as defined in claim 3 wherein said flexible conduit comprises a corrosion resistant flexible outer conduit and a corrosion resistant inner conduit disposed coaxially to said outer conduit, said inner conduit defining said second passageway therein and having said electrical conductor located thereon.

6. A heater assembly as define in claim 5 wherein said inner and outer conduits of said flexible conduit are formed from a fluoropolymer consisting of one of the groups of PFA, FEP, CTFE, PTFE, ECTFE, ETFE OR PVDF fluoropolymers to render said flexible conduit impervious to most chemicals at temperatures up to 450 degrees Fahrenheit.

7. A heater assembly as defined in claim 1 further included sensor means for controlling the energization of said electrical resistance heater, a sensor housing defining a sealed sensor chamber therein connected to said metallic sleeve assembly, said sensor chamber communicating with said first passageway, said sensor means being located in said sealed chamber in said sensor housing and including conductor means extending from said sealed chamber in said sensor housing to said first passageway in said metallic sleeve assembly and through said second passageway in said flexible conduit to direct electrical signals from said sensor means to a control for controlling the energization of said electrical resistance heater.

* * * * *